US006022170A

United States Patent [19]

Röwer

[11] Patent Number: 6,022,170

[45] Date of Patent: Feb. 8, 2000

[54] PAVER

[75] Inventor: Helmut Röwer, Obernkirchen, Germany

[73] Assignee: Allgemeine Baumaschinen-Gesellschaft mbH, Hameln, Germany

[21] Appl. No.: 09/150,654

[22] Filed: Sep. 10, 1998

[30] Foreign Application Priority Data

Sep. 10, 1997 [DE] Germany ..... 197 39 687

[51] Int. Cl.[7] ..... E01C 19/22; E04G 21/10

[52] U.S. Cl. ..... 404/96; 404/118

[58] Field of Search ..... 404/84.1, 84.8, 404/96, 118

[56] References Cited

U.S. PATENT DOCUMENTS 3,182,410 5/1965 Schiavi ..... 404/96

5,101,360 3/1992 Bennett ..... 365/505

5,507,591 4/1996 Lyons et al. ..... 404/96

FOREIGN PATENT DOCUMENTS 296 21 976 3/1997 Germany .

*Primary Examiner*—Thomas B. Will

*Assistant Examiner*—Gary S. Hartmann

*Attorney, Agent, or Firm*—John J. Selko; Mark A. Ussai

[57] ABSTRACT

The invention relates to a paver having a consolidation plank for the floating packing of layers, the consolidation plank consisting of two plank halves (1*a*, 11*b*), of which the angle of inclination relative to one another can be adjusted transversely to the packing direction and which are adjustable via a controllable adjusting device (7, 24). In order to lock the adjusting members (7) in the non-actuated state, the two plank halves (1*a*, 1*b*) are coupled to one another, so as to be free of play, via a brake (9) which is lifted while the adjusting device (7, 24) is being actuated.

5 Claims, 4 Drawing Sheets

PAVER

BACKGROUND OF THE INVENTION

The present invention relates to a paver for packing layers of road surfaces.

When two-lane roads are being built, the transverse profile along straight sections of road generally constitute a horizontal roof profile. At the commencement of a bend, however, the position of the roof profile should change from the horizontal to an inclination and the roof profile itself should change to a correspondingly inclined straight line. When a paver having a consolidation plank is used for the floating packing of the corresponding layers, the consolidation plank consisting of two plank halves adjustable relative to one another transversely to the packing direction, the adjustment of the roof profile is generally carried out manually via adjusting spindles and ratchets. After the adjustment operation has been concluded, the adjusting spindles have to be locked so that they are made free of play. This measure is absolutely essential, since the roof profile may otherwise change within the range of the existing play. This may lead, particularly in the case of large working widths, to appreciable differences in layer thickness and consequently to a loss of quality.

In the case of manual roof-profile adjustments, the operator is positioned directly above the adjusting members for the adjustment of the roof profile, so that locking can be carried out from there. However, if roof-profile adjustment is carried out electromechanically or electrohydraulically by a distant operator positioned not in the vicinity of the adjusting members, but, for example, at the edge of the road, locking the adjusting members or making them free of play presents a problem.

Furthermore, it is known from the German utility model DE 296 21 976 U1, in the case of a paver consolidation plank which is divided in order to produce a roof profile, for the drive for adjusting the inclination of the roof profile to be preceded by a reduction gear having a braking device, the said reduction gear serving for positioning the roof-profile adjustment and for ensuring freedom from play. In this case, however, it is necessary, on the one hand, to have the reduction gear, and on the other hand, to equip the latter appropriately by removing the play from the toothing of the reduction gear or providing locking and, consequently, bringing about corresponding sluggish movement in order to ensure braking, as a result of which the full force introduced is not available for adjusting the inclination of the roof profile, the design outlay is high and adjustment cannot be carried out via a hydraulic cylinder.

The object of the invention is to provide a paver in which the adjusting members for roof-profile adjustment are locked, and therefore play in the adjusting members is eliminated, only after each adjusting operation has been concluded.

The foregoing illustrates limitations known to exist in present pavers. Thus, it is apparent that it would be advantageous to provide an alternative directed to overcoming one or more of the limitations set forth above.

Accordingly, a suitable alternative is provided including features more fully disclosed hereinafter.

SUMMARY OF THE INVENTION

In one aspect of the present invention there is provided a paver, movable in a direction for packing road layers; the paver having a consolidation plank for the floating packing of road layers; the consolidation plank consisting of two plank halves, of which an angle of inclination relative to one another is adjustable transversely to the packing direction via a controllable adjusting device; the two plank halves being coupled to one another, so as to be free of play, via a brake which is lifted while the adjusting device is being actuated, characterized in that the brake is a spring-loaded brake with a piston which is arranged in a cylinder; the piston being spring-prestressed into its initial position and being adjustable counter to the spring prestress for the purpose of lifting the brake; the piston having a shank with a number of discs positioned thereon; the discs each forming friction surfaces; the discs being coupled to the one and the other plank halves, respectively; and the disc friction surfaces being displaceable relative to one another.

BRIEF DESCRIPTION OF THE DRAWING FIGURES

The invention is explained in more detail below with reference to an exemplary embodiment which is illustrated in the accompanying figures.

FIG. 1*a* shows diagrammatically a consolidation plank of a paver from the rear view;

FIG. 1*b* shows diagrammatically a consolidation plank of a paver from the top view;

FIG. 2 shows a hydraulic circuit for adjusting the plank halves of the consolidation plank of FIG. 1;

FIG. 3*a* shows an embodiment of a spring-loaded brake in section; and

FIG. 3*b* is a view similar to FIG. 3*a*, showing the brake engaged in an opposite position from the engagements shown in FIG. 3*a*.

DETAILED DESCRIPTION

Figure 1A:
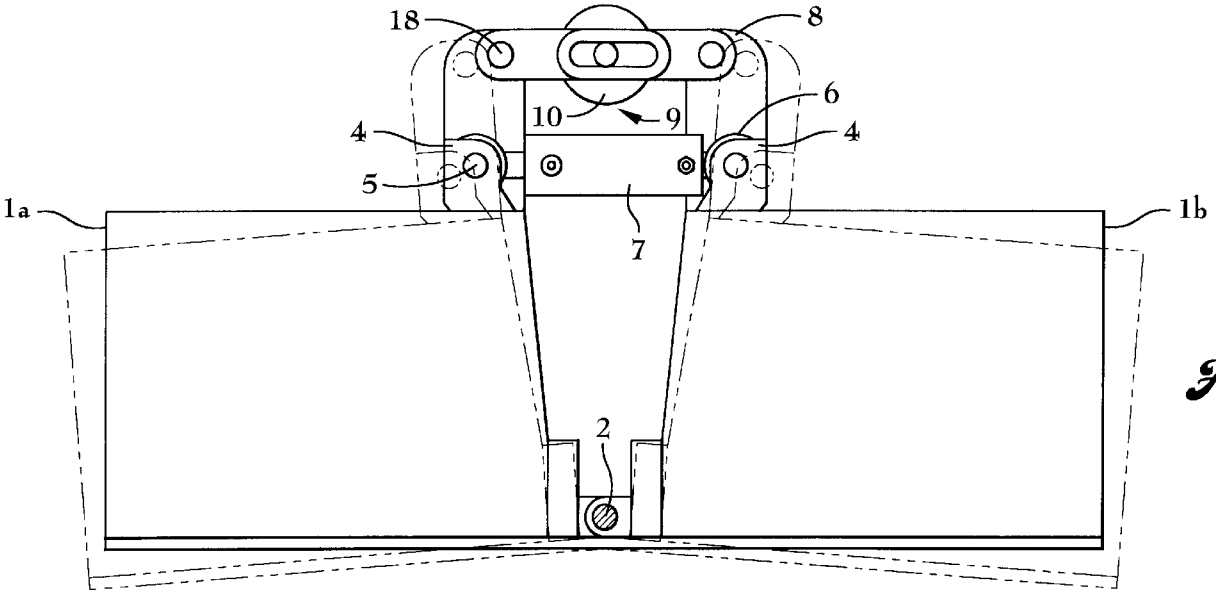
Figure 1B:
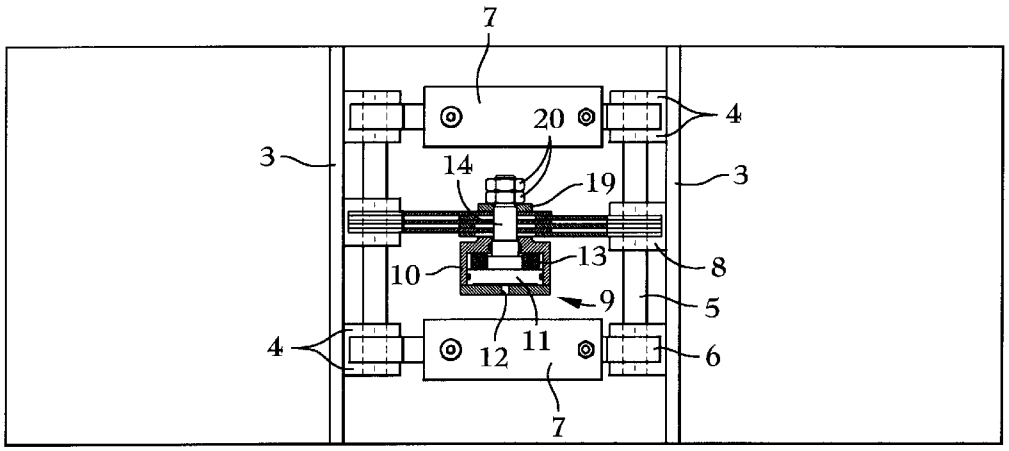

The consolidation plank of a paver, the said plank being illustrated in FIGS. 1*a* and 1*b*, serves for the floating packing of corresponding layers of a road and is articulated via tension arms (not illustrated) on an undercarriage which has, at the front, a bucket for receiving the packing material, from where the packing material is conveyed by means of a conveyor into the region of a distributor screw which is located in front of the consolidation plank in the packing direction.

The consolidation plank comprises two plank halves 1*a*, 1*b* which, if appropriate, can be extended and/or added to. The two plank halves 1*a*, 1*b* are pivotable relative to one another about a pin 2, the longitudinal axis of which extends in the packing direction, for example in order to form a roof profile, as indicated by dot-and-dash lines in FIG. 1*a*. A web plate 3 extending in the packing direction is fastened to the top of each plank half 1*a*, 1*b*. Bearing lugs 4 for receiving two bolts 5 are located opposite one another on the mutually confronting sides of the web plates 3, the said bolts extending through eyes 6 of two hydraulic cylinders 7 which are arranged therebetween and which form the adjusting members for the plank halves 1*a*, 1*b*. By the appropriate action of pressure fluid on the hydraulic cylinders 7, the two plank halves 1*a*, 1*b* are pivoted out of a position oriented in a straight line (illustrated by unbroken lines in FIG. 1*a*) into a roof-profile position (illustrated by dot-and-dash lines in FIG. 1*a*) or out of the latter into the position oriented in a straight line, in accordance with the intended road profile during the packing of a corresponding layer.

Figure 3A:
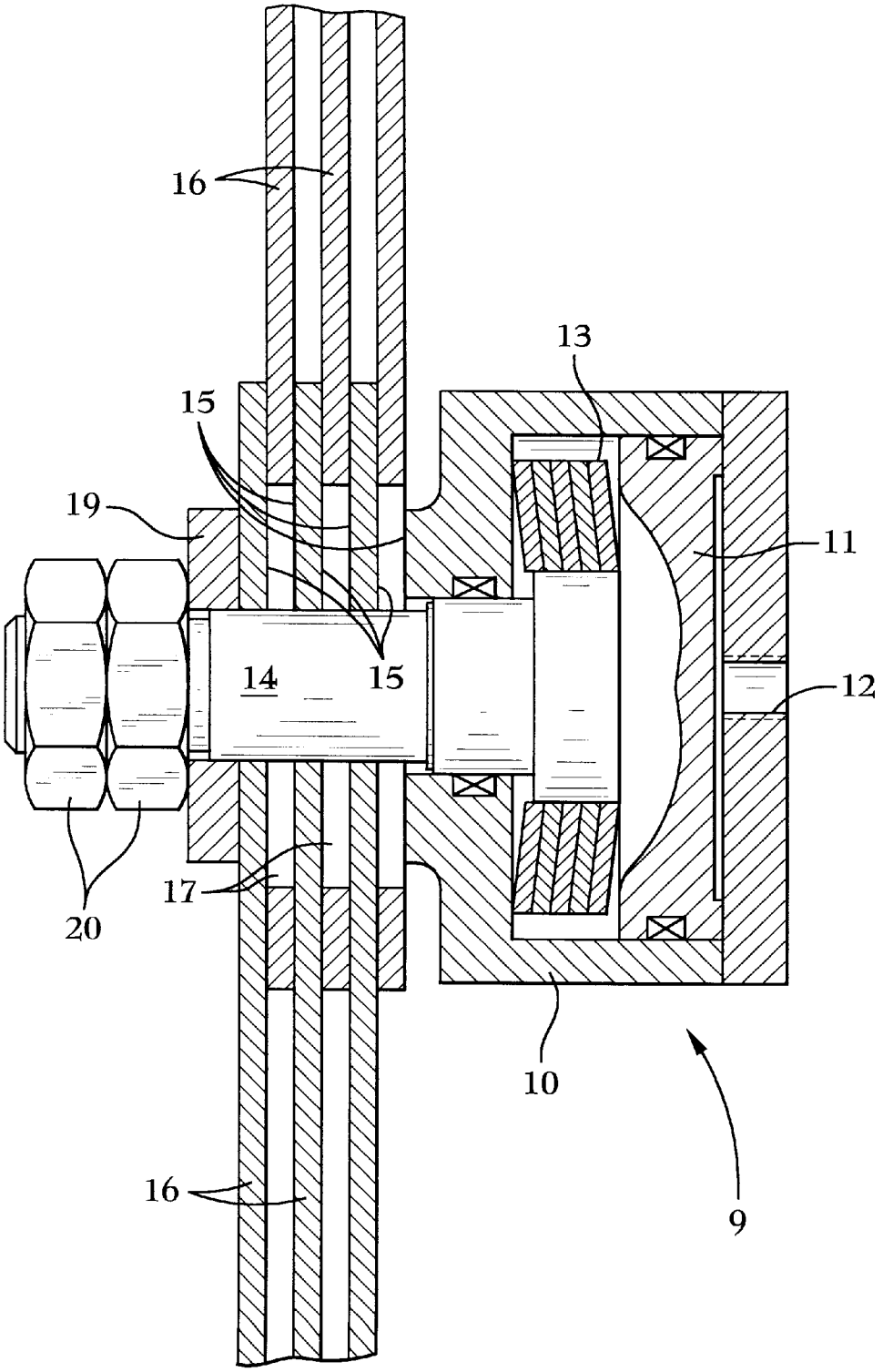
Figure 3B:
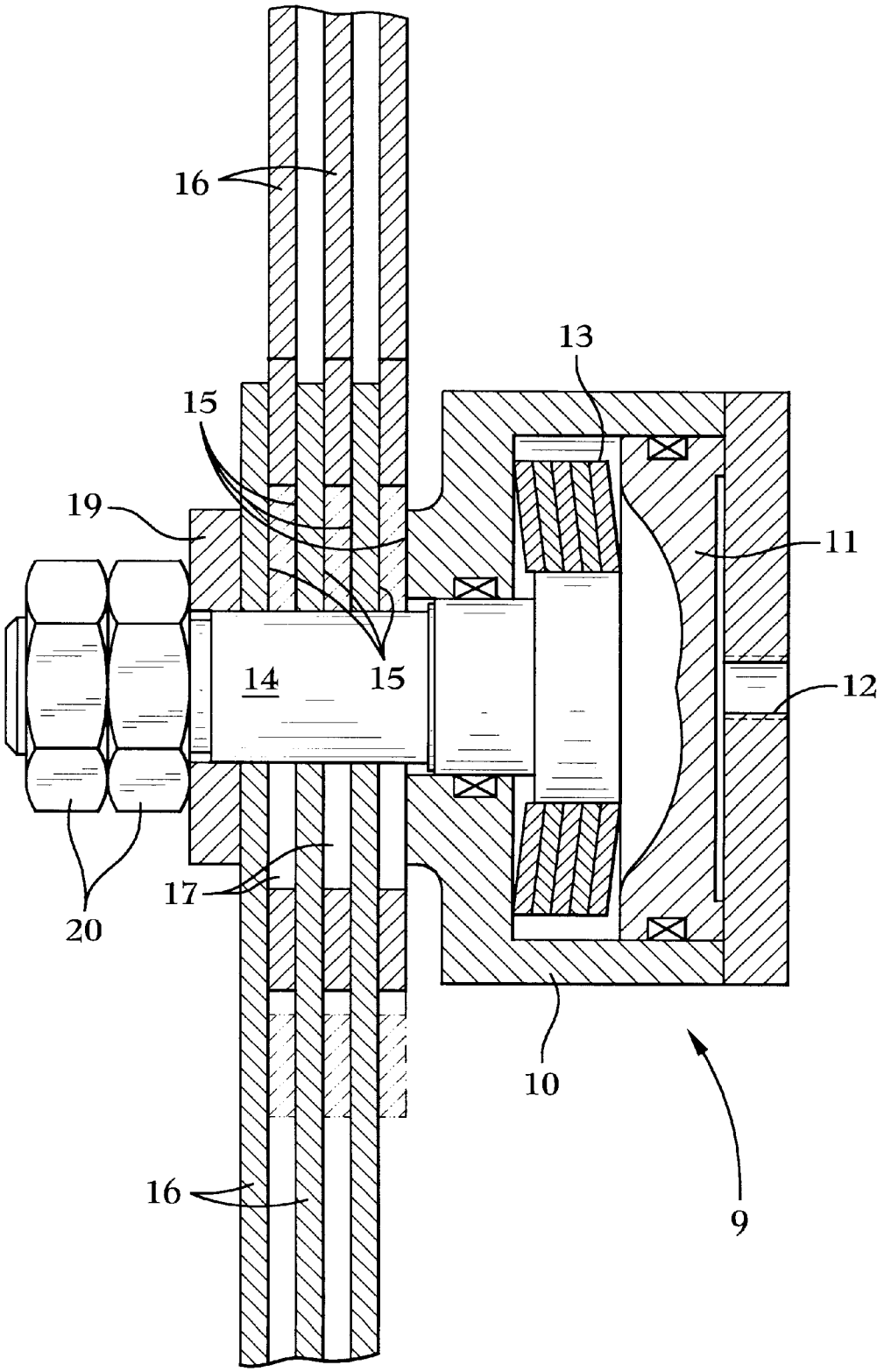

Moreover, bearing lugs 8 for receiving a spring-loaded brake 9 are provided opposite one another on the mutually confronting sides of the webs 3 and, here, are arranged above the bearing lugs 4 and between the hydraulic cylinders 7. The exemplary embodiment of the spring-loaded brake 9 illustrated in FIG. 3 comprises a cylinder 10, in which is arranged a piston 11, on which pressure can act via a pressure-fluid inlet 12. The piston 11 is prestressed in its initial position by a spring assembly consisting of cup springs 13 and possesses a shank 14 which extends out of the cylinder 10 and is provided at the end with a thread.

The spring-loaded brake 9 possesses friction surfaces 15 formed by metal sheets 16 having long holes 17, the said sheets being arranged in pairs and so as to engage one in the other and being rotatably mounted, in each case opposite one another, on bolts 18 received by the bearing lugs 8. The shank 14 of the piston 11 extends through the long holes 17 and carries, on the side facing away from the cylinder 10, a washer 19 and two self-locking nuts 20.

Figure 2:
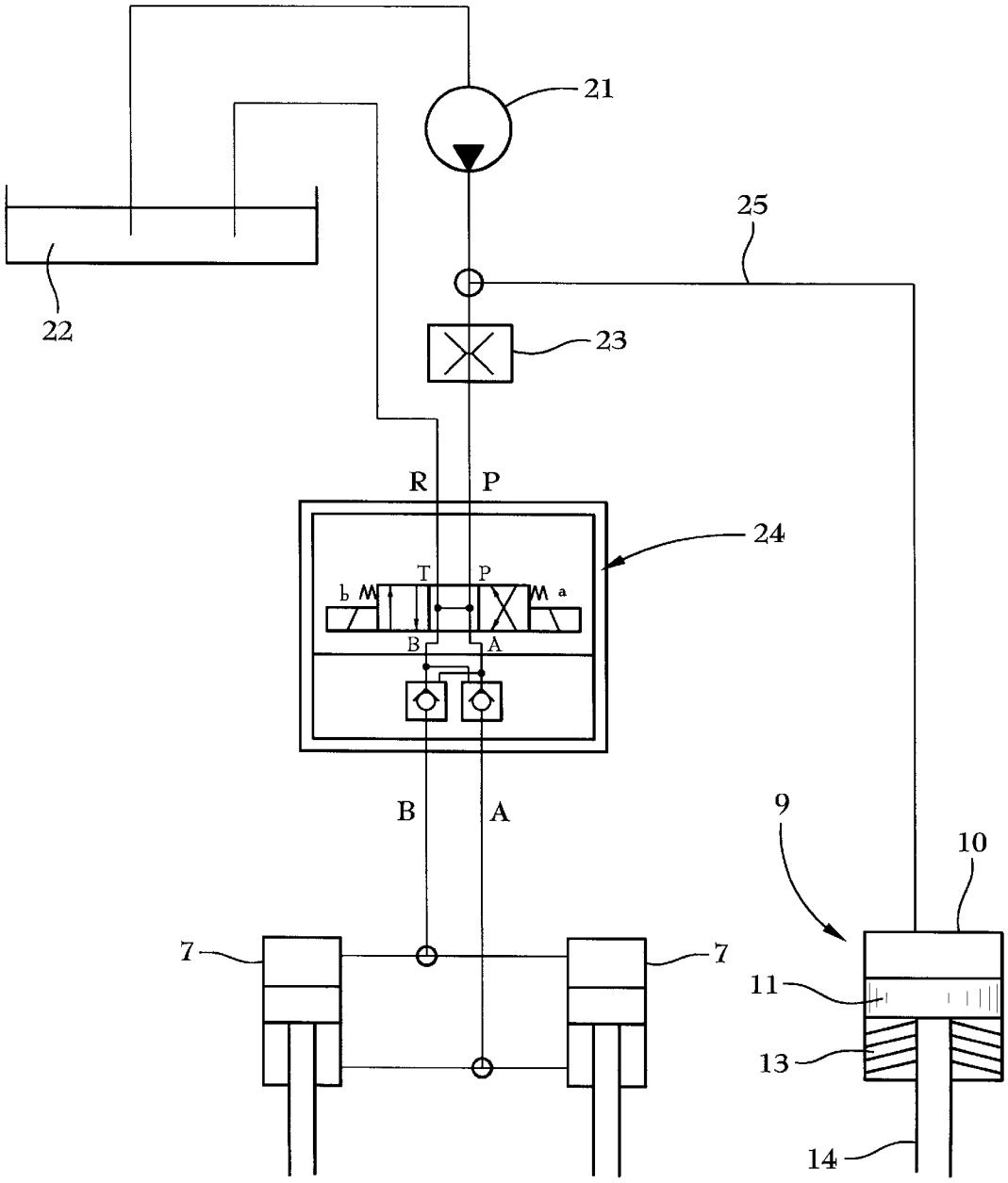

According to FIG. 2, a pump 21, connected to a supply 22 of hydraulic fluid, generates appropriately pressurized hydraulic fluid which arrives via a restrictor 23 at an electromagnetic control valve 24. Appropriate activation of the control valve 24 causes action to be taken on the double-acting hydraulic cylinders 7 for the mutual adjustment of the board halves 1*a*, 1*b*.

The hydraulic fluid pressure prevailing downstream of the pump 21 acts on the cylinder 10 via a conduit 25. When the control valve 24 is actuated in order to adjust the hydraulic cylinders 7, a pressure rise is obtained in the conduit from the pump 21 to the control valve 24 and acts via the conduit 25 on the piston 11 of the cylinder 10, so that the piston 11 is displaced counter to the force of the cup springs 13 and correspondingly lifts the friction surfaces 15 from one another. When action on the hydraulic cylinders 7 has ended, the pressure rise diminishes again and the piston 11 is forced by the force of the cup springs 13 back into its initial position, in which the friction surfaces 15 are once more in engagement with one another and the spring-loaded brake 9 exerts its full braking action mechanically and eliminates any play caused, for example, by leakage.

Instead of hydraulic cylinders 7, spindles, which can be driven electrohydraulically or electromechanically, for example via chain wheels, may be used as adjusting members. In this case, in the embodiment illustrated, action may be taken hydraulically on the spring-loaded brake 9, via an electrically actuable valve in a corresponding hydraulic circuit, when the spindles are being driven, for the purpose of lifting the said brake.

By means of the spring-loaded brake 9, not only can the packing quality be improved, but the adjustment operation can also be simplified.

The spring-loaded brake 9 may also be capable of being lifted electromagnetically.

Instead of the spring-loaded brake 9, a brake may also be used, in which the braking force is applied by a hydraulic pressure which is generated via an accumulator and which must then be relieved by means of a suitable circuit during the adjustment operation. Furthermore, the braking force, as well as relief during the adjustment operation, may be applied pneumatically or electromagnetically.

Thus, it can be understood that there is provided herein a brake designed as a spring-loaded brake in which two halves are coupled to one another and which is lifted as a result of the actuation of the adjusting device and, due to the ending of the adjusting operation, resumes its full braking action, in order to eliminate any play, for example in spindles, or play resulting from leakage in hydraulic cylinders. The latter takes place irrespective of the magnitude of the adjusting operation and automatically, the full force introduced being available for adjustment.

Having described the invention, what is claimed is:

1. A paver, movable in a direction for packing road layers; the paver having a consolidation plank for floating packing of road layers; the consolidation plank comprising two plank halves, of which an angle of inclination relative to one another is adjustable transversely to the packing direction via a controllable adjusting device; the two plank halves being coupled to one another, so as to be free of play, via a brake which is lifted while the adjusting device is being actuated, characterized in that the brake is a spring-loaded brake with a piston which is arranged in a cylinder; the piston being spring-prestressed into its initial position and being adjustable counter to spring prestress in order to left the brake; the piston having a shank with a number of discs positioned thereon; the discs each forming friction surfaces; the discs being coupled to the one and the other plank halves, respectively; and the disc friction surfaces being displaceable relative to one another.

2. The paver according to claim 1, characterized in that the brake has a number of friction surfaces, the number of which is variable according to width and design of the consolidation plank.

3. The paver according to claim 2, characterized in that the discs are provided with elongated holes and are arranged in pairs, the discs being rotatably mounted, in each case opposite one another, on a bolt.

4. The paver according to one of claims 3, characterized in that the brake is positioned between two adjusting members of the adjusting device which are include hydraulic cylinders.

5. The paver according to one of claim 4, characterized in that the brake is liftable by a pressure fluid used for actuating the adjusting device.

* * * * *